US005586867A

United States Patent [19]

Mehlos

[11] Patent Number: 5,586,867

[45] Date of Patent: Dec. 24, 1996

[54] DIRECT MOUNTED FAN APPARATUS

[76] Inventor: Michael D. Mehlos, Hwy. E, Watertown, Wis. 53094

[21] Appl. No.: 183,739

[22] Filed: Jan. 19, 1994

[51] Int. Cl.[6] ..... F04B 49/06

[52] U.S. Cl. ..... 417/45; 416/170 R

[58] Field of Search ..... 417/45, 423.15, 417/423.6, 424.1, 319, 360, 362; 416/5, 170 R, 244 R

[56] References Cited

U.S. PATENT DOCUMENTS

| | | | |
|---|---|---|---|
| 1,982,022 | 12/1934 | Bothezat | 417/362 |
| 2,741,351 | 4/1956 | Fletcher et al. | 416/170 R |
| 2,838,913 | 8/1958 | Peterson et al. | 416/170 R |
| 2,933,240 | 4/1960 | Breese | 416/170 R |
| 4,430,576 | 2/1984 | Fowler | 318/305 |
| 4,716,409 | 12/1987 | Hart et al. | 340/825.22 |
| 4,730,981 | 3/1988 | Kawai | 416/83 |
| 4,840,543 | 6/1989 | Geberth, Jr. | 417/319 |
| 4,878,806 | 11/1989 | Markwardt | 416/5 |
| 4,884,947 | 12/1989 | Rezek | 416/5 |
| 4,900,236 | 2/1990 | Kapaan | 417/354 |
| 5,007,811 | 4/1991 | Hopkins | 135/16 |
| 5,189,412 | 2/1993 | Mehta et al. | 340/825.22 |
| 5,215,447 | 6/1993 | Wen | 417/319 |
| 5,281,093 | 1/1994 | Sedlak et al. | 416/5 |

FOREIGN PATENT DOCUMENTS

| | | | |
|---|---|---|---|
| 737400 | 7/1943 | Germany | 417/319 |
| 1503630 | 3/1969 | Germany | 417/362 |
| 516932 | 2/1955 | Italy | 416/170 R |
| 84509 | 7/1920 | Switzerland | 416/170 R |
| 683743 | 12/1952 | United Kingdom | 417/319 |

*Primary Examiner*—Timothy S. Thorpe
*Assistant Examiner*—Xuan M. Thai
*Attorney, Agent, or Firm*—Andrus, Sceales, Starke & Sawall

[57] ABSTRACT

A ceiling mounted fan unit includes a lamp based connector adapted to be threaded into a threaded lamp socket to releasably mount the fan to the ceiling. The fan unit is a lightweight unit including an integrated motor drive which is coupled to a rotating fan blade support structure by a speed reducing torque increasing coupling unit. The coupling unit may include a belt drive, a friction drive and a direct gear drive. A releasable housing is secured to the fan unit to permit coordinated decorative fan blade with the room. An auxiliary support structure can be incorporated into the fan unit to physically engage a wall socket to supplement the physical support. An electrical control circuit incorporates various safety controls to prevent minimized hazards as a result of the drive system of the electrical system. The fan blades are releasably connected to the support to permit changes in the decorative characteristic of the fan blades.

5 Claims, 5 Drawing Sheets

FIG. 5
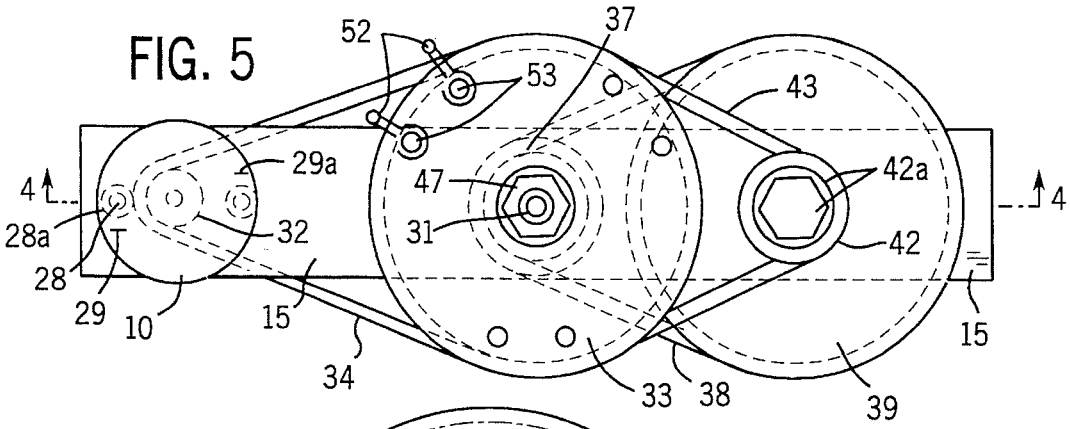
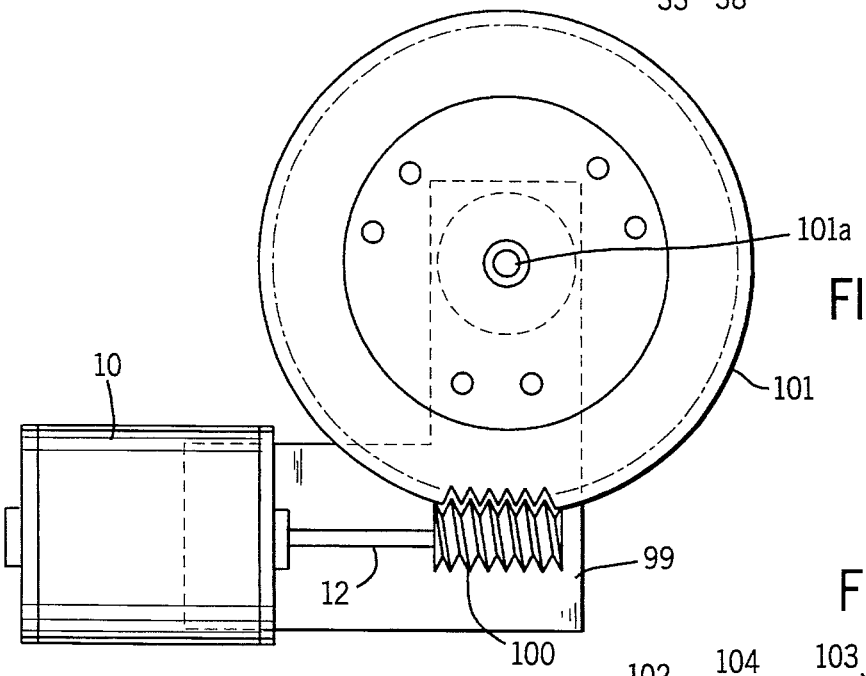
FIG. 7
FIG. 8a
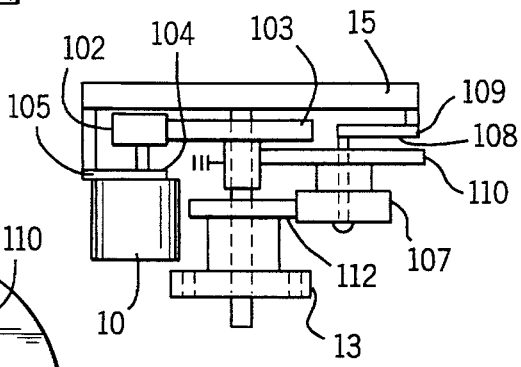
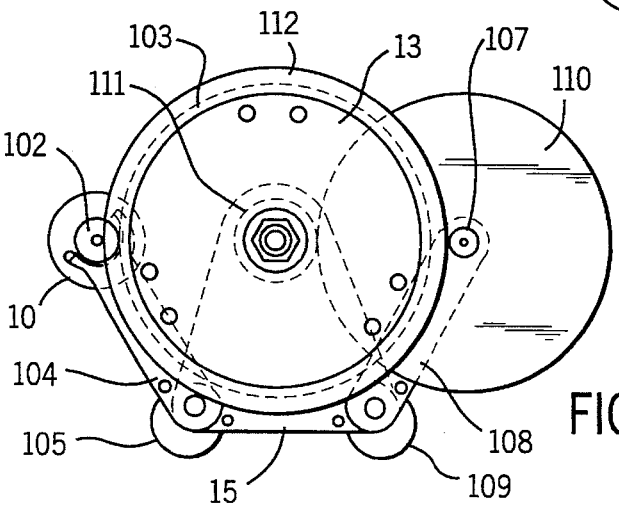
FIG. 8

DIRECT MOUNTED FAN APPARATUS

BACKGROUND OF THE INVENTION

This invention relates to a direct mounted fan apparatus and particularly to such a fan apparatus including convenient, and cost effective mounting and power apparatus.

Ceiling mounted fans have been widely used for many years in connection with environmental room control. Such ceiling mounted fan units have been particularly widely used in tropical, and high temperature environments for many, many years. The fans are primarily used to create an air circulation within the room areas to create a cooling effect as a result of moving air over the occupants and things in the room. With the more recent energy crisis, ceiling mounted fan units have been used not only for cooling purposes, but for improved circulation of heated air to improve the heating efficiency created within a room environment. Such ceiling mounted fan units, for institutional and commercial applications as well as for domestic, home and like installations, have generally included direct motor drive systems which are specially constructed and fixedly mounted to the ceiling with direct hard wired power connections to the power distribution systems of the buildings. If a lighting system is associated therewith, it is provided as an auxiliary unit attached to the ceiling fan unit with separate power connection to the lighting unit and interconnected generally with a separate switching control.

It is well known that heat rises within the room environment. A ceiling mounted fan unit will drive the rising heated air downwardly and recirculate the heated air to establish a more uniform heat environment within the room, and particularly reuse the hot air rising to the ceiling as it moves downwardly throughout the room. Variable speed controls are often incorporated into the ceiling fan unit to permit adjustment of the velocity of air circulation for controlling the environmental temperature more efficiency. Thus, the fan unit can be constructed for either establishing a cooling or heating effect.

Typical ceiling mounted fan units are disclosed in U.S. Pat. Nos. 4,878,806 issued Nov. 7, 1989; 4,900,236 issued Feb. 13, 1990; 4,884,947 issued Dec. 5, 1989 and 4,730,981 issued Mar. 15, 1988. As noted above and generally to the inventor's knowledge, all such units are permanently affixed to the ceiling structure and hard wired directly into the power distribution system. The fan units are relatively substantially heavy units and generally require licensed electricians for installation, with the attendant cost. As a result, ceiling fan units as presently installed in domestic home applications are relatively costly. In industrial and institutional applications, the rugged and expensive constructions as well as installation costs may be generally acceptable as providing a highly cost effective cooling and heating system. In domestic installations, the cost effectiveness is not as readily accepted nor as widely used as might otherwise result if a more cost effective system were available.

SUMMARY OF THE PRESENT INVENTION

The present invention is particularly directed to an improved direct mounted fan unit or apparatus which is specially constructed for direct mounting to a fixed electrical receptacle or connector providing a direct releasable mounting and electrical power connections. The fan unit is optionally a light weight unit which can be reliably interconnected to a light or other power receptacle with minimal, if any, additional mechanical support structure. Generally in accordance with the teaching of the present invention, a lightweight fan unit is provided including a motor, and preferably a permanent magnet D.C. motor of a relatively high speed characteristic, is coupled through a speed reducing/torque increasing coupling to drive a plurality of lightweight fan blades. A lightweight outer enclosure is provided about the drive system consisting of the motor and drive speed reduction coupling to the blade support unit. The system can be readily provided with suitable adjustable speed controls, additional receptacles for receiving of lamps or the like, while maintaining the necessary lightweight assembly permitting the direct mounting into an existing lamp socket or the like.

More particularly in one preferred embodiment of the invention, the fan unit includes a lamp base connector adapted to be threaded into a threaded lamp socket. Other types of releasable socket and base connectors may also be employed in place of the threaded arrangement. A mounting plate is provided with a high speed motor secured to the plate along with the speed reduction and torque increasing coupling mechanism to drive a rotating fan support. The lightweight fan blades are secured to the rotating support. A cup-shaped enclosure is secured to the base mounting plate to enclose the motor and coupling system as well as the driven support. The driven support may project downwardly through the bottom wall of the cup-shaped enclosure with the connection of lightweight fan blades to the exposed portion thereof. The fan blades may be formed of a lightweight plastic material, of a metal frame with a thin film plastic covering, or any other construction which will minimize the weight of the fan blades required for the direct releasable support in accordance with the teaching of the present invention.

The fan unit can be readily demounted for repair and maintenance. In addition, the fan unit can be custom decorated to the room decor and decorations. The convenient removal of the fan unit will also provide for a more convenient and therefore less expensive redecoration of the ceiling as by painting and the like.

The present invention thus provides a simple, cost effective fan unit which can be conveniently and rapidly installed.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 5 is a bottom elevational view of the fan unit;

FIG. 7 is a plan view of an alternate drive system for the fan unit; and

FIGS. 8 and 8a are views of a further embodiment of the drive system.

DESCRIPTION OF THE ILLUSTRATED EMBODIMENT

Figure 1:
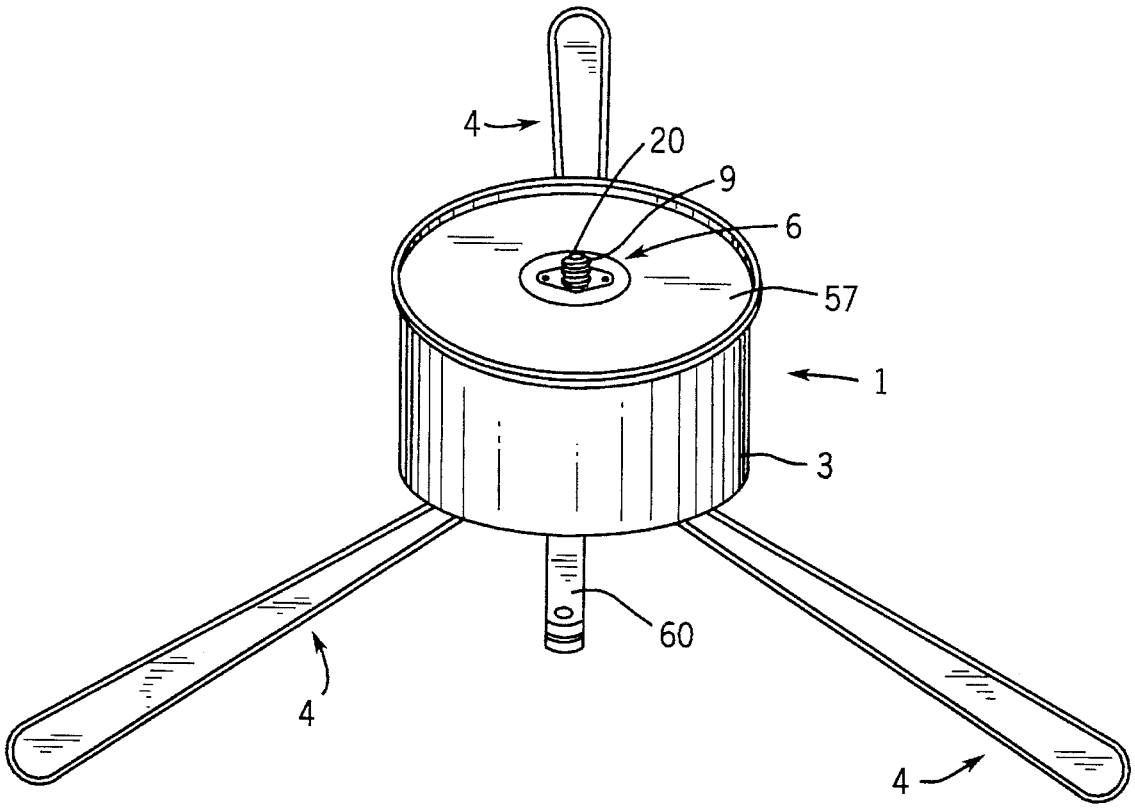
FIG. 1 is a pictorial view of a fan unit constructed in accordance with the teaching of the present invention.
Figure 2:
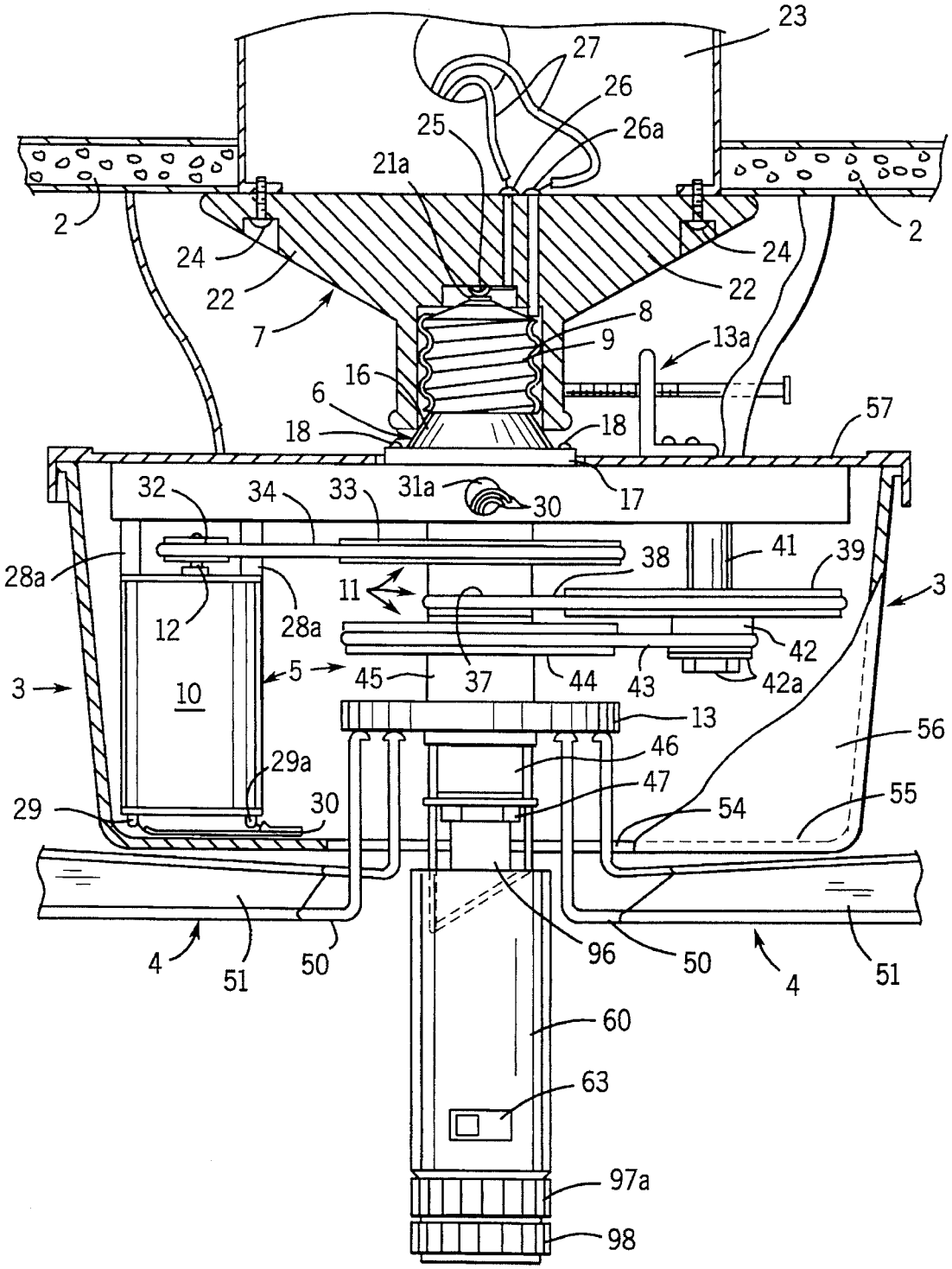
FIG. 2 is a side elevational view of the fan unit mounted to a ceiling wall, with parts broken away and sectioned.

Referring to the drawings and particularly to FIGS. 1 and 2, a ceiling fan unit 1 is shown operatively mounted to a ceiling 2. The fan 1 includes a housing 3 abutting the ceiling 2. A plurality of fan blades 4 are rotatably mounted to a motor drive system 5 mounted within the housing 3. A mount unit 6 for supporting of the fan unit 1 to the ceiling 2 is located within the housing 3 and is releasably secured to a conventional light socket unit 7 in the embodiment of FIGS. 1–5. The fan unit 1 may present an appearance generally similar to that of a typical prior art ceiling mounted fan unit.

As more particularly shown in FIGS. 2–5, the present invention is directed to the mounting unit 6, the drive system 5 and fan blades 4, which provide for direct electrical interconnection of the drive system upon the releasable mounting of the fan unit 1 to the ceiling mounted support unit 7.

Figure 3:
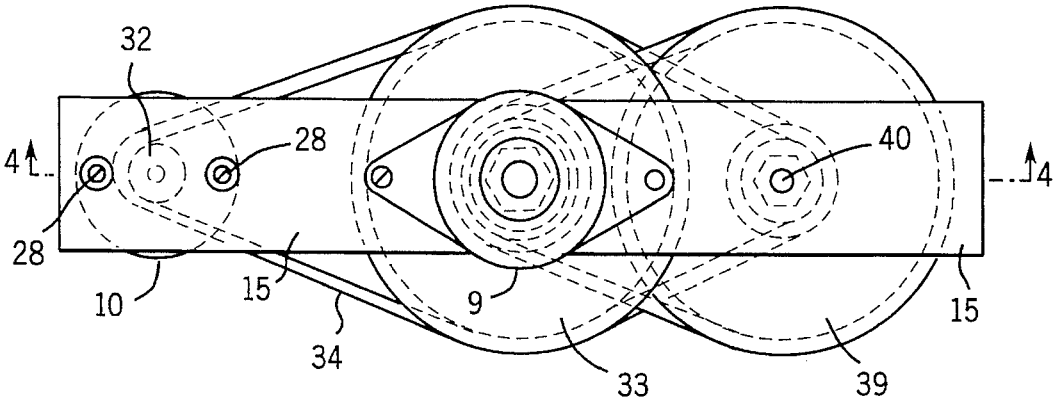
FIG. 3 is a plan view of the fan unit.
Figure 4:
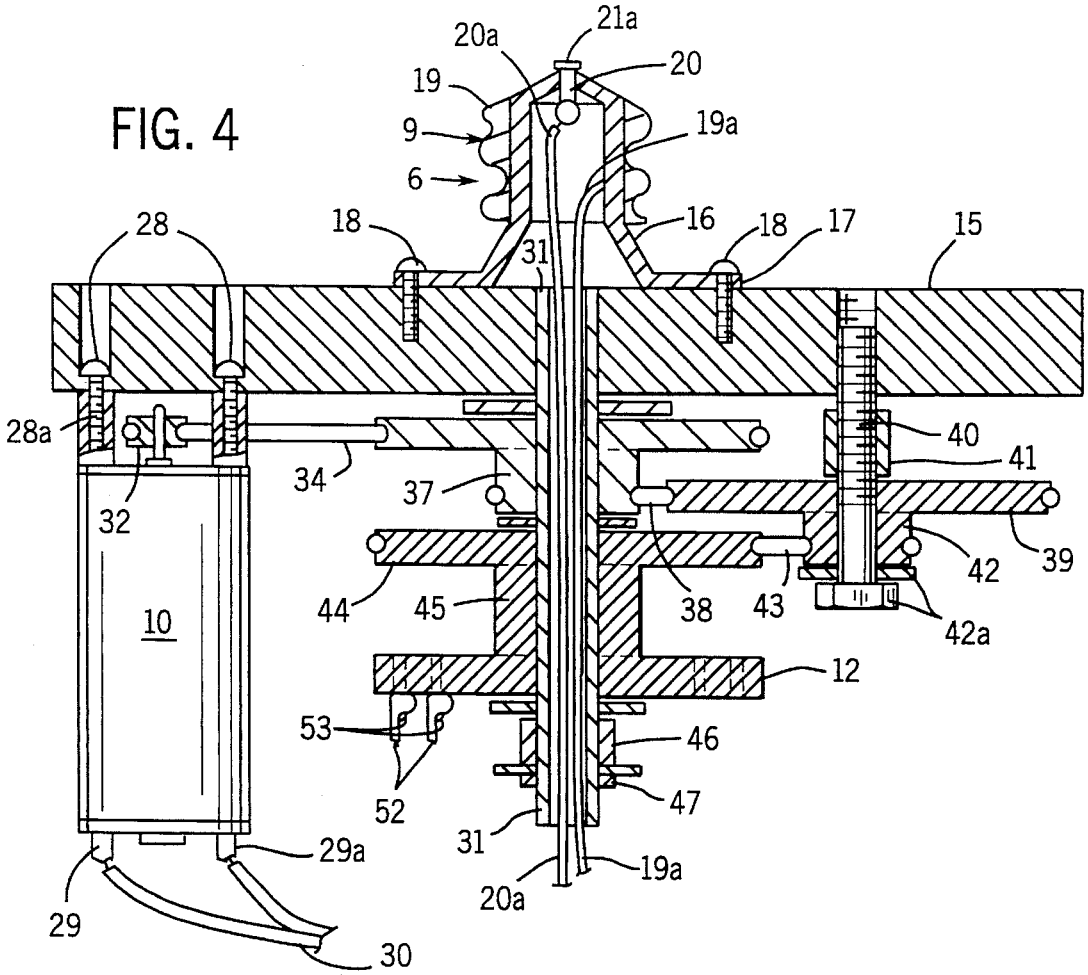
FIG. 4 is a sectional view taken generally on line 4—4 of FIG. 3 and illustrating the fan drive system of the embodiment shown in FIGS. 1–3.
Figure 6:
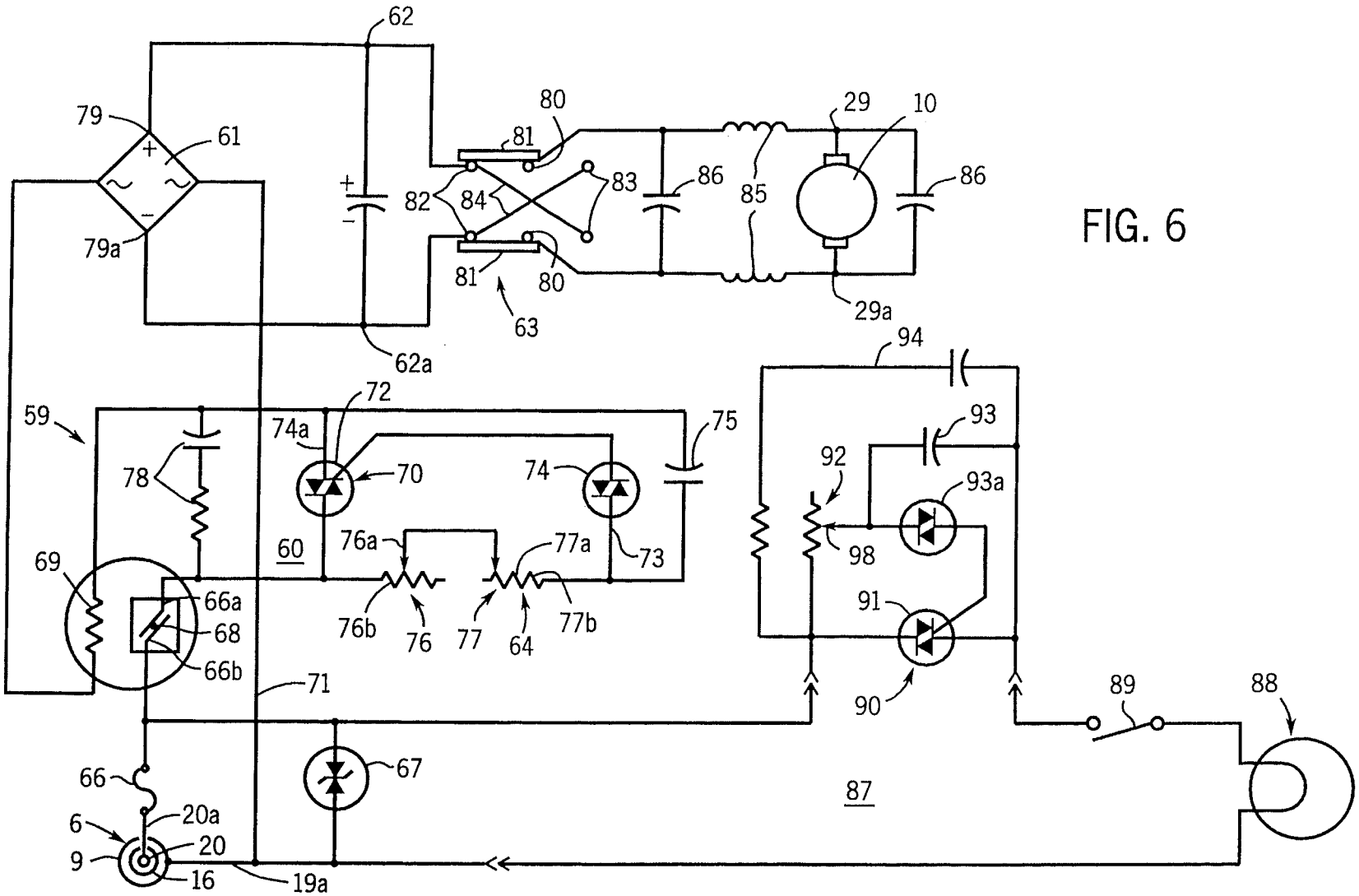
FIG. 6 is a schematic circuit for the fan unit.

Referring to FIGS. 2 and 3, in particular, the ceiling mounted light socket unit 7 has a metal socket 8 of a conventional threaded construction. The fan mount unit 6 includes a conventional threaded metal base connector 9 which threads directly into the socket 8 to provide a direct mount of the fan unit 1 to the socket unit 7 and thereby to the ceiling 2. The socket-type connection provides electrical power into the fan drive system 5 and particularly a small high speed electric motor 10 and may provide the sole physical support of the fan unit 1. As hereinafter described, a speed reduction/torque increasing coupling 11 interconnects the output shaft 12 of the motor 10 to a driven blade plate 13 which is generally centrally located within the housing. The fan blades 4 are direct coupled to driven plate 12 for operation in response to selective closing of a power circuit, such as shown in FIG. 6, from the connector 9 to the motor 10.

The socket connection between the mount unit 6 and the socket unit 7 is shown including an auxiliary and stabilizing support Structure 13*a* which is interconnected between the housing 3 of the fan unit 1 and the wall socket unit 7. The support structure 13*a* further physically supports the fan unit with the direct releasable power connection, and permits variation in the weight of the fan unit 1.

In accordance with the base teaching of the present invention, the fan unit 1 is constructed as a self-contained unit having a releasable power connector 6 for connection to a standard wall mounted unit 7, such as a threaded socket and base coupling, as illustrated, with a minimum physical support requirement and in particular permits the releasable mounting without separate opening of a hard-wired electrical connection or direct physical special ceiling mounting. Fan unit 1 is thus a light weight assembly permitting direct releasable mounting and circuit connection using a standard releasable receptacle available in conventional power distribution systems for homes and other building structures.

More particularly, in the first illustrated embodiment of the invention, the fan support or mount unit 6 includes a rigid plate 15 spanning the upper end of the housing 3. The connector 6 includes an insulating body member 16 with an outer metal threaded member intimately affixed thereto. The insulating member is shown as a rigid and solid member with a flange 11 secured to plate 15 by pins 18. The threaded metal connector 9 is secured to the member 16 and provides a firm support of an outer metal connector sleeve 19. The connector sleeve 19 is interconnected to a circuit lead 19*a* to define a common circuit connection to neutral or ground. In accordance with conventional construction, the insulating member has a center conducting stem 20 connected to a circuit lead 20*a* to define the power lead. The stem 20 terminates in the outer end in a contact button 21*a*.

The circuit leads 19*a* and 20*a* are connected as the power leads to the circuit shown in FIG. 6 and hereinafter described.

The socket unit 7 is illustrated as a well known conventional unit having an outer ceramic mounting housing 22 which is secured in abutting relation to a circuit box 23 by suitable mounting screws 24. A center power terminal 25 is a spring-like element mounted centrally of the threaded sleeve 8. The terminals 25 and 8 are connected respectively to terminal screw units 26 and 26*a*. The incoming power distribution wires 27 are secured to the screw units 26 and 26*a* to provide power into the mount unit 6 for connection into the circuit of FIG. 6.

The motor 10 is physically secured to the underside of the mount plate 15 as by mounting bolts 28 with spacing sleeves 28*a*. The motor 10 is preferably a permanent magnet (PM) direct current motor, with the speed of the motor adjustable through the current level supplied to the motor, as more fully described hereinafter. The motor 10 is preferably a relatively high speed motor and includes the output shaft 12 which projects upwardly between sleeves 28*a*. For example, a 50 volt and 0.3 ampere motor is readily available as a suitable light weight and small size for use in the present invention. Power terminals 29 and 29*a* secured to the back end or plate of the motor 10 are connected by suitable leads 30 to the circuit of FIG. 6 and thereby to the power leads 19*a* and 20*a*.

The output shaft 12 is coupled to drive the fan blade plate 13 through the speed reducing/torque increasing coupling 11. In the embodiment of FIGS. 1–5, the coupling 11 is shown as a three stage pulley assembly including three stages mounted in stacked relation on a fixed support tube 31 (FIG. 4) secured to the mount plate 15 and extending downwardly therefrom.

Tube 31 is secured to the plate 15 which includes an opening 31*a* providing access to the open tube 31. The motor leads 30 are extended through opening 31*a* and the center of tube 31 for connection into circuit with the power leads and the control circuit as hereinafter described.

The first stage includes a small pulley 32 fixed to the motor shaft 12. The small pulley is affixedly secured to the shaft as by a press fit, a set screw or other connection to establish and maintain fixed rotation of the pulley with the motor shaft. The pulley 32 is coupled to a large pulley 33 by a pulley belt 34. Pulley 33 is rotatably mounted on the upper end of the fixed tube 31. A thrust washer 35 or other suitable bearing is disposed between the plate and the pulley. The internal opening of the pulley 33 may be formed with an integral radial bearing 36, or a separate radial bearing may be provided, to provide low friction support of the pulley on the fixed shaft. The pulley is a relatively large pulley whereby a plurality of rotations of the small pulley 32 is required to affect a single revolution of the large pulley 33. In one embodiment, the first stage had a ratio of 6 to 1 and the second and third had a ratio of 4 to 1. A thrust washer is also disposed between the upper pulley and the adjacent pulley of the intermediate or second pulley unit. The second pulley stage includes pulley 37 integrally attached to the large pulley 34 for rotation therewith. Pulley 37 is coupled by a pulley belt 38 to an offset large pulley 39 which is rotatably mounted on a fixed support rod 40, shown in alignment with the motor shaft 12 and the support tube 31. The fixed rod is secured as by a threaded connection or otherwise to the underside of the plate 15 and depends downwardly therefrom. A cylindrical thrust bearing 41 is located on the rod between the support plate 15 and the top side of the pulley to locate the pulley 39 and support the pulley against upward axial thrust. The underside of the pulley 39 includes a relatively small pulley 42 of the third pulley stage. A thrust washer and nut 42*a* is secured to the end of the rod 40 as by a threaded connection and supports the pulleys 39–42 on rod 40. A pulley belt 43 connects pulley 42 of the third stage to a pulley 44 on the tube 31. An integral extension 45 connects the pulley 44 to the blade plate 13.

The pulley assembly on tube 31 is supported by a spacer and thrust washer assembly 46 secured to the lower threaded end of the tube 31 by a threaded nut 47.

The several pulleys and other members rotatably mounted on tube 31 and rod 40 having integral radial bearings to properly support the members for long rotational life.

The fan blades 4 are direct coupled to the plate 13 and rotate therewith beneath the support structure of the pulley assembly and the housing.

In the illustrated embodiment of the invention, each blade 4 includes a rod or wire-like frame 50 in the form of an elongated generally U-shaped member. The frame defines the perimeter of the blade 4 which is covered by a suitable cover 51 of plastic, cloth or the like. The cover 51 can be formed as a generally open ended unit adapted to slip over the frame structure and completely cover the frame up to the housing 3. In the illustrated embodiment, the coupling end of the frame 50 includes upwardly offset or bent members 52 which project upwardly with the uppermost ends secured to the rotating plate 13. The ends are shown secured to the plate 13 by suitable set screws 53. Any other interconnection which will support the blades 4 located for rotation with the drive system may be used.

The blade cover is shown extending over the coupling end up to and even into the lower end of the housing.

In the first illustrated embodiment of the invention, the plate 13 is located within the housing 3 with a central opening 54 in the bottom wall 55 of the housing 4 for accommodating the coupling ends 52 of the blade frames 50.

The illustrated construction provides a simple, light weight fan blade which can be conveniently constructed and interconnected to the coupling system. In addition, the releasable cover structure provides for convenient adaptation to various decors and design requirements as well as permitting convenient removal for cleaning of the blade cover structure.

Other simplified or even fixed blade constructions can be employed, if desired. For example, light weight plastic, such as styrofoam or the like, may be formed as a blade member adapted to be releasably connected to the coupling through a suitable interconnection connected to the blade or as a common coupling for receiving various styrofoam blades as well as other blades adapted for connection to a releasable coupling secured to the pulley member. For example, a simple depending L-shaped bracket may be provided depending from the pulley. The lower leg of the L-shaped bracket would project outwardly to receive a preformed fan blade which could be connected thereto through any desired coupling such as a set screw, a spring loaded device or other mechanism. The structure may be of any suitable type which provides a light weight assembly for acceptable direct mounting to a convention releasable power receptacle such as lamp receptacles, a plug-in unit or other similar standard receptacles and electrical connector units as presently in use or hereinafter developed.

The illustrated housing 3 is shown including a tubular side wall 56 which encircles the total assembly. A side wall 56 is secured to plate 15 in any suitable means as by removable set screws and top wall 57 closes the upper end. The bottom wall is shown as the planar wall in an inward extension from the side wall 56 to the blade frame members. The housing is formed of any suitable material and preferably a light weight plastic or other material and adapted for convenient changing of the decor. The housing is preferably readily released and removed for servicing as well as for decorative variation, either by direct replacement or by decorating the exterior surface of the housing. The structure provides a very simple effective means for changing of the appearance for coordinated design of the total room decor.

In summary, the total fan unit or system is formed as a relatively light weight assembly including a motor, a drive coupling system and a power control circuit mounted within the enclosure for attachment to a power receptacle fixed to a building structure for both releasable physical and power connection.

Generally, the control circuit 59 includes a switching circuit 60 selectively connecting the incoming power supply wires or leads 19*a* and 20*a* to a rectifier 61 for converting the conventional AC power supply to a DC power supply at the output leads 62 and 62*a* of the rectifier. The output leads 62 and 62*a* are connected to energize the motor 10.

A forward and reverse switch 63 connects the DC output of the rectifier to the motor 10 to control the direction of rotation of the motor. The switching circuit 60 is shown as a solid state semiconductor switching circuit shown as including a Triac. A current level control 64 is connected in the switching circuit 60, and controls the current level supplied via rectifier 61 to the motor 10 and thereby the speed of the motor 10. A thermal responsive current limit unit 65 connects the output of the switching circuit 60 to the input side of the rectifier 61.

Adjustment of the speed control 64 directly controls the speed of the motor and thereby rotation of the blades 4. The forward/reverse switch 63 controls the directional rotation of the motor 10 and thereby the rotation of the fan blades 4 for selectively moving the air upwardly or downwardly with respect to the environment.

More particularly, the input connecting circuit from leads 19*a* and 20*a* to the switching circuit 60 includes a fuse link 66 interconnected in series with the power lead 20*a*. A voltage limit switch 67 such as a solid state dual Zener diode unit, a varistor or other suitable voltage limiting device is connected between the output side of the fuse link 66 and the opposite common lead 19*a* connected to the threaded sleeve 19 of base unit 6. The fuse link 66 protects the system against abnormal current flow while the limit switch 67 prevents the output voltage from arising above a relative safe voltage level, such as 150 volts. Thus, if the lamp base is inserted into a higher voltage system, the switch 67 provides for an essentially short circuit resulting in an essentially instantaneous opening of the fuse and thereby the circuit.

Under normal operation, the power line 20*a* is connected into the switching circuit in series with the thermal responsive safety current limit unit 65.

The safety current limit unit 65 is selected to protect against fire hazards and the like by responding to abnormal current conditions. In the illustrated embodiment of the invention, the unit 65 is a switch unit including a conventional fusable link, shown as having a pair of spaced switch contacts 66*a* and 66*b* normally connected by a heat responsive disruptable and conducting member 68. The member 68 is responsive to heat and at a given heat level rapidly disintegrates or is disrupted and opens the contacts. The switch contacts 65 are mounted immediately adjacent to a resistor 69 connected in a lead between the switching circuit 60 and rectifier 61. In a practical application, the switch contacts 66*a* open at a resistor temperature of about 50 degrees Fahrenheit (°F.) above the normal resistor temperature. Such temperature corresponds to the defined maximum motor speed, with a specified nominal voltage as measured across the motor leads or terminals 29 and 29*a* at full load. The input to the switching circuit 60 was thus opened, and motor energization prevented.

The switching circuit 60 may be any suitable switching or other control circuit to vary the power supplied to the rectifier 61 and thereby the motor 10. In the illustrated embodiment of the invention, a solid state switching circuit is illustrated including a triac unit 70 having one side connected directly in series with safety switch 65 to the incoming fused power lead 20*a*. The opposite side or main terminal of the triac 70 is connected in series with the thermal resistor 69 in the input side of the rectifier. The opposite input of the rectifier 61 is connected via a line 71 directly to the return lead 19*a* from the connecting base member 9. The triac 70 is a triggered solid state semiconductor unit and includes a gate 72 connected to the power supply through a speed control branch circuit 73. A break down diac 74 is connected in series with in the gate lead and holds the triac in a non-conducting state until an appropriate voltage is applied across the diac 74 in series with the gate 72 to a power terminal 74*a* of the triac 70. A capacitor 75 is connected across the diac 74 and the gate to power the diac 74 and the gate power terminals of the triac 70. In the illustrated embodiment, a pair of series connected variable resistor units 76 and 77 are interconnected between the input power terminal of the triac and the gate 72. The resistor units are illustrated as adjustable potentiometers. The one unit 76 establishes a maximum speed limit for the motor and the second unit 77 allows variation of the speed from a minimum to the selected speed limit. Each potentiometer 76 and 77 includes an adjustable tap 76*a* and 77*a* adapted to be adjustably positioned on the associated potentiometer resistors 76*b* and 77*b*. The resistor 76*b* of potentiometer 76 is connected to the main terminal lead. The resistor of the potentiometer 77 is connected to the diac. The taps 76*a* and 77*a* are connected in series to complete the circuit between the resistors 76*b* and 77*b*.

The current flow through the resistor circuit is adjusted by the setting of the taps 76*a* and 77*b* on the respective resistors. With the tap 76*a* positioned to essentially bypass the limit resistor 76*b*, maximum current is allowed to flow from the power supply via the speed limit resistor 76*b* to set the highest motor speed.

The speed limit potentiometer is preferably factory set to positively prevent establishing an unwarranted safe speed of the motor operation. Although such speed may not trigger the thermal alarm or safety current limit system, excessive current can operate the motor and drive the fan units at a damaging speed. The speed control, of course, is accessible to the operator or externally of the fan to permit adjustment of the motor speed.

As the tap 76*b* is moved to an intermediate resistor position, resistance is inserted into the circuit and establishes a voltage drop in the gate circuit, which limits the speed of the motor to a lesser maximum.

The speed control potentiometer 77 similarly controls the resistance inserted into the circuit. With minimum resistance, the maximum speed as set by the potentiometer 76 will be created. As the resistance is increased, the speed will drop as a result of reducing the current level in the gate circuit.

The voltage applied across the gate circuit is determined by the current flow through the potentiometer resistors 76*a* and 77*a* and the capacitor 75. When the charge on the capacitor 75 rises to the firing level of the diac 74, the capacitor discharges through the gate and turns the triac 70 on. Power current flows through the main triac terminal and thus to the rectifier 61 through the safety resistor 69. The current level is controlled by the setting of the potentiometers 76 and 77 and varies with the resistance level in the branch circuit. The input power supply is an alternating current and thus the triac is triggered during each half cycle as a result of the polarity reversal of the incoming power. The diac 74, however, will fire on either polarity of the capacitor charge and thus provides a current flow through the circuit during each half cycle. Once the triac is fired and on, it continues to conduct for the balance of the half cycle even though the capacitor is discharged.

In the illustrated embodiment of the invention, a relatively large capacitor and a resistor 78 is connected directly across the output terminals of the full wave rectifier. The circuit essentially is average and smooth out the DC pulses generated by the rectification of the alternating current and also functions to further reduce noise and RF signals within the motor circuit.

The rectifier is shown as a well known full wave bridge rectifier having the input terminals or sides connected respectively to the leads from the switching circuit. In accordance with known technology, the full wave rectifier 61 conducts each half cycle of the current with the switching circuit on. The output is a positive direct current flow from the rectifier positive output terminal 79 to the motor terminal 29, with the return from the motor terminal 29*a* to the negative side 62*a* of the rectifier and the ground side of the power supply.

The forward/reverse switch 63 is shown as a double-pole, double-throw slide switch having a set of common contacts 80 and slide contacts 81 physically coupled to each other for selective engagement of contacts 80 with first and second sets of fixed output contacts 82 83. The common contacts 80 are connected to the opposites sides of the motor 10. The first set or forward power contacts 82 are connected directly to the output terminals 62 and 62*a* of the full wave rectifier 61. The oppositely located or reverse power contacts 83 are located to the opposite side of the common contacts and are connected by crossed wires 84 to the forward contacts 82. With the switch slide 81 in the full line position shown (referred to be a forward drive position) the power flows directly from each forward contact to the aligned common contacts for supplying current flow through the motor 10 in a forward direction, shown in FIG. 6 from the top side of the motor to the bottom side of the motor.

Moving of the switch slide 81 to the alternate phantom line position results in the power being applied through the cross lines in a reverse flow to the terminals or sides of the motor, thereby creating a reverse rotation of the motor.

LC circuits are connected in the leads between the directional switch 63 and the motor 10 to further reduce an interfering signal and particularly signals resulting from switching between forward and reverse rotation. Thus, each of the leads between the switch and the motor is broken and include a series connected inductor coil 85. Capacitors 86 are connected in parallel with the common switch contacts 86 and motor terminals 29 and 29*a*. The inductor, for example, can conventionally be a wire wound inductor wound on a ferrite rod or the like.

An optional lighting circuit 87 is shown in FIG. 6. The optional lighting circuit includes a lamp receptacle, such as a socket 88, provided on the housing assembly and connected in parallel with the protected AC circuit, and shown connected directly across the voltage limiting Zener diode unit 67*a*. A main on/off switch 89 is shown in series with the lamp for completing the circuit. Switch 89 may be part of a dimmer control circuit connected in series with the lamp. Dimmer circuits are well known. The illustration thereof includes a switching circuit 90 similar to the main switching circuit 60 including a main triac 91. An adjustable potentiometer 92 is connected in series with a capacitor 93 to selectively fire the gate circuit through a diac 93*a* and thereby turn on the triac 91 each half cycle. A smoothing circuit branch 94 in parallel with the triac provides a substantially constant energization of the lamp unit 88.

In practice, equicircumferentially distributed lamps may be secured to the unit and be connected in parallel circuit with the illustrated lamp, shown in FIG. 6. An on/off switch is shown connected to one side of the housing. Two rotating dial switches are illustrated mounted in stacked relation in the lower end of the housing. The dial unit provides for varying of the motor speed while the other dial unit provides adjustment of the illumination level of the lamp(s). The support structure may include a drape rod unit for draping the total fan unit to an appropriate level relative to the ceiling. This merely requires the extension of a rod-like support from or to a socket member.

The control circuit of FIG. 6 can be readily assembled with conventional and well known circuit board technology and as a small compact unit, not shown. The unit may be mounted within the housing; or conveniently mounted within a tubular housing 95 secured to the pulley support tube 31. The tubular housing unit can be separately formed with an upper threaded member 96 for securing the control unit to the tube 31 and thus the fan support structure. The wiring system can, of course, be extended through tube 31 into connection to the power lines and the motor leads. The reverse/forward switch 63 may be secured to the side of the housing and the adjustable tap 77*a* for the setting of the speed is incorporated into a rotating knob unit 97 connected to the bottom of the housing. A second knob unit 98 connected below unit 97 may be provided to control a light dimmer where provided.

FIG. 7 illustrates an alternate embodiment of the drive unit for drivings of the motor 10 using a gear drive system. The motor 10 is shown horizontally mounted by a suitable mounting support bracket 99 which would in turn be interconnected to the lamp socket support unit. The output shaft 12 of the motor 10 includes a worm gear 101 meshing with a large gear 100 connected to a rotating blade shaft 101*a*. A slip clutch, not shown, may be incorporated into the gear drive to prevent damage if the blade engages an object. The gear ratio is such as to reduce the speed of the blade plate and the interconnected fan blades. This permits construction of a relatively flat housing structure but may require a greater diameter or outer dimensional configuration depending upon the motor system, motor construction and the required gear reduction to obtain the necessary output torque and control speed. A stepped multigear system may be provided. The motor may also be mounted in a vertical orientation with one or more gear sets to provide for appropriate blade drive. The selection may be controlled by the design of the housing for esthetics or other reasons.

Similarly, rather than using of a pulley or even a gear drive, a direct drive, or a friction drive may be provided such as shown in FIGS. 8 and 8*a*. In this embodiment, the motor 10 is vertically oriented and includes a relatively small friction drive drum 102. A motor 10 is mounted on an arm 104 pivotally connected to the mounting plate 15. A spring 105 urges the motor and drum 102 inwardly into engagement with drum 103. A driven drum 111 is connected (shown as integral) with drum 113, which in turn engages and drives a drum 110. A drum 107 is integral with drum 110. The drums 107 and 110 are mounted on swinging arm 108 which is also spring biased inwardly as by a spring 109. Drum 107 drive a drum 112 . Drum 112 is connected to a blade plate 13 as in the first embodiment.

The present invention may thus include various forms of couplings including those shown as well as others, all of which again necessarily consider the weight and drive characteristics by those familiar with drive systems.

Although shown as a standard threaded light bulb connection, any other type of a conventional or suitable power receptacle can be used. Providing a simple additional mechanical interconnection, the fan unit may be directly mounted to a plug-in receptacle in the ceiling and the like. The ceiling receptacle would be provided with some form of a depending bracket. The fan unit would include a conventional plug for plugging into the receptacle and a related bracket for interconnection to the ceiling bracket to physically support the assembly.

Thus, the present invention is particularly directed to the concept of providing direct releasable interconnection of a fan unit and a power receptacle for connecting power directly through a conventional power distribution outlet used in homes and the like and readily available without the necessity for special installation by a licensed electrician. The fan unit is therefore of an appropriate weight and with an appropriate drive system to establish the necessary speed and torque appropriate for ceiling mounted fans and thus generally corresponding to the existing and conventional ceiling mounted fan units. The drive system, of course, must be carefully selected so as to maintain the operation with the conventional acceptable current specifications of the circuit to which it is applied.

Various modes of carrying out the invention are contemplated as being within the scope of the following claims particularly pointing out and distinctly claiming the subject matter which is regarded as the invention.

I claim:

1. A fan unit for direct releasable mounting to a wall mounted power receptacle, comprising a support unit having an electrical connection means adapted to be releasable inserted into said receptacle with a physical and electrical interconnection between said support unit and said receptacle to physically support the fan unit and to connect electrical power to said electrical connector means, a fan blade support structure rotatable secured to said support unit, a plurality of fan blades secured to said fan blade support structure, a small high speed motor unit secured to said support unit, a speed reducing drive coupling between said motor unit and said fan blade support structure for reducing the speed at said support structure and rotating of said fan blades, an enclosure enclosing said motor and said speed reducing drive coupling to physically support the fan unit and to connect electrical power to said electrical connector means, a control unit mounted within said enclosure and connected to control the speed of said motor and thereby the rotation of said fan blades, and control members secured to said support structure and located beneath said enclosure for ready access, wherein said motor is a permanent magnet D.C. motor and said motor control includes an AC power input, a solid state switching circuit having a power supply connection to said AC power input and including a variable impedance for controlling the turn on of said switching circuit in response to the incoming AC power input, a full wave rectifier connected to the output of said switching circuit and having an output connected to said motor control, and a reversing switch unit interconnected in said connection between the output of said rectifier and said motor for controlling the rotation direction of said motor, and separate movable control members secured to said support structure and extending from the lower portion of said enclosure for ready recess thereto.

2. The fan unit of claim 1, including a current limit control responsive to the current flow to said rectifier and operable to open the power supply connection to said switching circuit in response to a selected current level, and a voltage limit control connected to the input side to the power supply connection to open the power supply connection to the switching circuit in response to abnormal voltage to a selected voltage at the input to said switching circuit.

3. The fan unit of claim 1, including a first speed control for limiting the maximum power supplied to said rectifier and thereby establishing the maximum speed of said motor, a second variable speed control having an external control unit for varying of the speed of the motor between zero and said selected maximum speed.

4. A wall mounted fan unit adapted to be mounted to a building wall mounted power receptacle forming a part of the building power distribution system, comprising a support structure, an electrical connector secured to said support structure and having electrical elements adapted to be releasably connected to said receptacle and thereby provide a direct power input to said fan unit, a fan blade support secured to said support structure, a plurality of fan blades secured to said fan blade support structure, a permanent magnet motor to physically support the fan unit and to connect electrical power to said electrical connector means and a speed reducing drive coupling connecting the output of said motor to said fan blade support and operable to rotate said fan blade support, said motor being directly connected to said electrical connector for receiving power from said receptacle, said coupling of said connector and receptacle establishes a physical support of said fan unit, a motor control is secured to said support structure and including an AC power input, a solid state switching circuit having a power supply connection to said AC power input, said motor including a variable speed control unit, said switching circuit connected to said speed control unit to vary said motor speed, said switching circuit including a current limit control responsive to the current flow to said motor and operable to open the power supply connection to said switching circuit in response to a selected current level, and a voltage limit control connected between said AC input and said switching circuit to open the power supply connection to the switching circuit in response to an abnormal input voltage.

5. The fan unit of claim 4 wherein said speed control unit includes a first speed control for limiting the maximum power supplied to said motor and thereby establishing the maximum speed of said motor, and a second variable speed control having an external control unit for varying of the speed of the motor between zero and said selected maximum speed.

* * * * *